United States Patent [19]

Riggs

[11] Patent Number: 4,699,044

[45] Date of Patent: Oct. 13, 1987

[54] FLUID CYLINDER DEVICE WITH PRECISION STROKE ADJUSTMENT

[75] Inventor: Charles B. Riggs, Rockford, Ill.

[73] Assignee: Maremont Corporation, Carol Stream, Ill.

[21] Appl. No.: 725,430

[22] Filed: Apr. 22, 1985

[51] Int. Cl.[4] ..... F01B 31/14; F15B 15/24

[52] U.S. Cl. ..... 92/13.6; 92/13

[58] Field of Search ..... 92/13.6, 13.8, 13.4, 92/13; 220/361; 277/188 R, 188 A, 227, 235 A

[56] References Cited

U.S. PATENT DOCUMENTS

| | | | |
|---|---|---|---|
| 935,387 | 9/1909 | Mastin | 277/227 |
| 1,375,200 | 4/1921 | Barnickel | 92/13.6 X |
| 2,222,819 | 11/1940 | Light | 92/13.6 |
| 2,427,755 | 9/1947 | Wedeberg | 92/13.6 |
| 2,538,812 | 1/1951 | Umberger | 92/13.6 |
| 2,761,347 | 7/1953 | McKee, Jr. | 277/227 X |
| 3,249,019 | 5/1966 | Seeloff | 92/13.6 X |
| 4,088,064 | 5/1978 | Tsunemoto et al. | 92/13.6 |

*Primary Examiner*—Robert E. Garrett
*Assistant Examiner*—Mark A. Williamson
*Attorney, Agent, or Firm*—Allegretti, Newitt, Witcoff & McAndrews, Ltd.

[57] ABSTRACT

A pneumatic and hydraulic cylinder includes a precision adjustment mechanism for precise adjustment of piston rod extended position. The rod is slidable within a sleeve, which is screw threaded or otherwise adjustably mounted to the cylinder. The sleeve includes a stop for the piston, adjustably establishing the extended position.

4 Claims, 1 Drawing Figure

FLUID CYLINDER DEVICE WITH PRECISION STROKE ADJUSTMENT

BACKGROUND OF THE PRESENT INVENTION

This invention relates to fluid cylinder devices, such as hydraulic and pneumatic cylinder devices, having stroke adjustment mechanisms.

Pneumatic and hydraulic cylinders are widely used mechanical drive components. Precision in cylinder piston rod movement is often desirable or required. Precise placement of a cylinder is often not possible, and despite precise placement, changes in other drive components, non-drive machinery components, workpieces and work processes occur. As a result, precise adjustment of piston rod stroke length and stroke end positions, both retracted and extended, is desirable.

To date, precision stroke adjustment mechanisms have been so limited as to provide adjustment of the stroke length and retracted position only, to the exclusion of adjustment of the piston rod extended position.

SUMMARY OF THE INVENTION

An object of the inventor in making the invention of this specification was to create a commercially useful fluid cylinder with a precision adjusting mechanism for precise adjustment of piston rod advanced position.

In a principal aspect, the invention is a fluid cylinder device comprising a fluid cylinder, a piston rod, a piston, and two elements described in "means plus function" terminology. The piston is mounted to the piston rod and in the fluid cylinder. The piston is so mounted for movement of the piston and rod in an extending direction and a retracting direction. A stopping means is mounted on the cylinder for stopping the movement of the piston and rod in the extending direction at an extended position. An adjusting means is operatively connected to the stopping means for adjusting the stopping means to adjust the extended position.

The stopping means is preferably a sleeve against which the piston abuts in the extended position, and through which the piston rod passes. The sleeve is adjustably mounted as by screw threads to a sleeve bushing fixed in position on the cylinder. Adjustment occurs by manual movement of the sleeve relative to the bushing.

Other objects, advantages and features of the invention will be understood from the description of the preferred embodiment, which follows.

BRIEF DESCRIPTION OF THE DRAWING

In the accompanying drawing, the preferred embodiment of the invention is shown, with the left half cut away and cross-sectioned to reveal internal detail.

DETAILED DESCRIPTION OF THE PREFERRED EMBODIMENT

Figure 1:
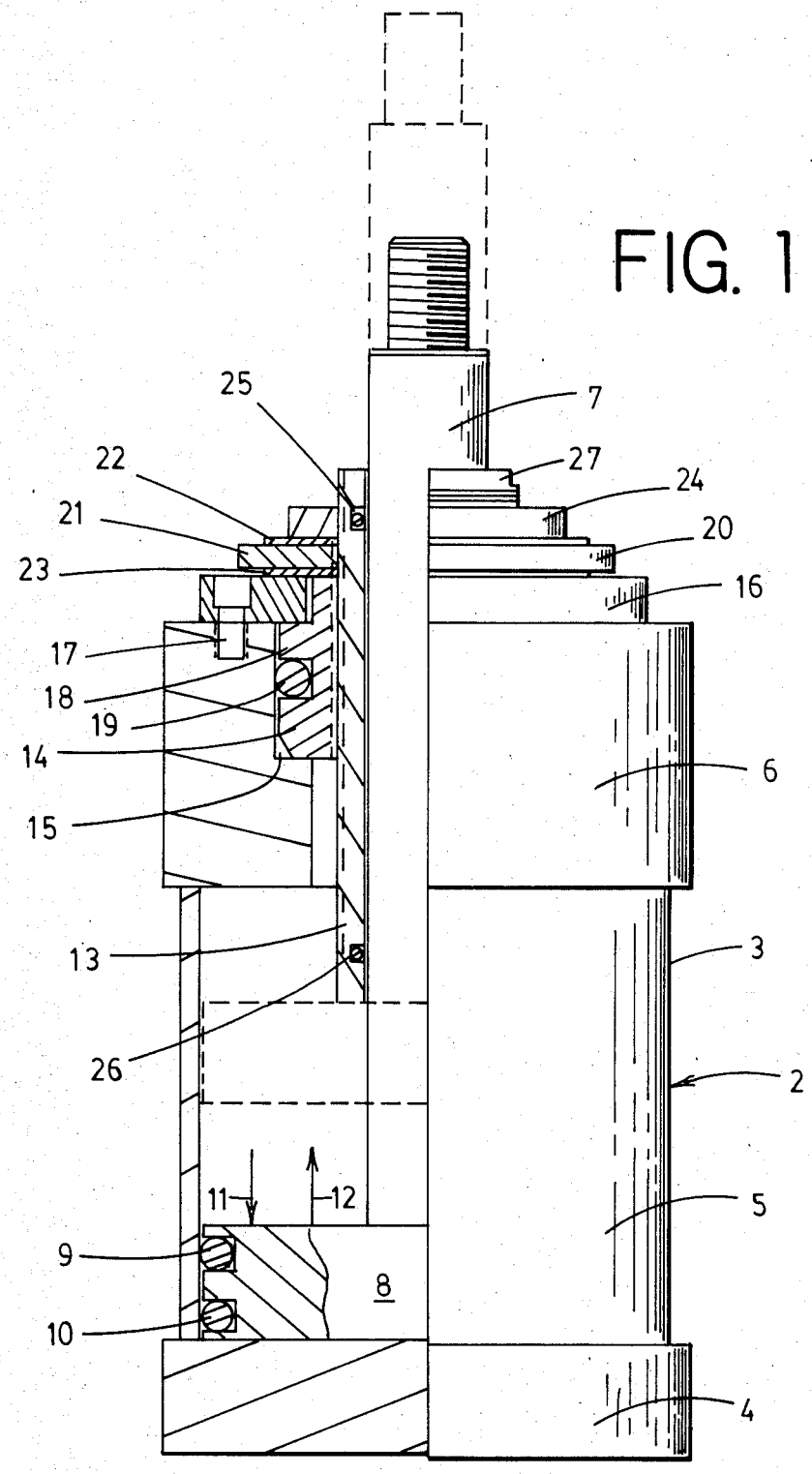

Referring to the accompanying drawing, the preferred embodiment of the invention is a fluid cylinder device such as a pneumatic or hydraulic cylinder device 2. The device includes a fluid cylinder 3 having a base 4, cylindrical sidewall 5, and a cylinder head 6. The base, sidewall, and head are sealed to each other.

A piston rod 7 is affixed to a piston 8 in the cylinder. The piston includes seals such as seals 9, 10 about the periphery against the cylinder wall 5. The piston slides within the cylinder under fluid pressure (fluid fittings are not shown, for clarity of drawing) and the piston rod follows. The piston and rod are movable in a retracting direction to a retracted position, as shown, and in an extending direction 12 to an extended position, as shown in phantom.

The extended position is adjustable. Defining the movement of the piston and rod from the retracted position to the extended position as the stroke, the stroke is also adjustable.

The extended position is set by abuttment of the piston against the end of an adjusting sleeve 13. An adjusting sleeve bushing 14 is located within a recess 15 of the cylinder head, and screw threaded to the adjusting sleeve. The bushing and sleeve have operatively cooperating screw threads which accomplish threading.

The bushing 14 is held or retained within the recess 15 by a bushing retainer plate 16. A plurality of fasteners such as 17 affix the plate to the head, over the recess and against a ledge 18 of the bushing. A seal 19 encircles the bushing in a groove, sealing the bushing against the head recess wall.

A thread seal 20, comprising a washer 21 with opposed rubber coatings 22, 23 surmounts the retainer plate 16. The seal is held to the plate by being screwed onto the sleeve and by a jam nut 24. The nut is screw threaded to the sleeve 13.

The piston rod 7 is mounted within the sleeve 13, and the sleeve 13 is located through the head 6, bushing 14, retainer 16, seal 20 and nut 24. The rod is slidable within the sleeve. Two seals 25, 26 seal the rod against the sleeve.

The sleeve is movable relative to the head, through manual threading movement. Wrench flats such as flat 27 are on the sleeve, external to the cylinder 3 and the nut 24. Release of the nut 24 provides for manual threaded movement of the sleeve 13. Because the bushing 14 is fixed in position relative to the cylinder 3, threaded movement of the sleeve causes movement of the sleeve relative to the bushing and the cylinder. Sleeve movement results in relocation of the extended position of the piston and rod, through movement of the sleeve end against which the piston abuts.

Adjustment of the stroke and piston extended position is thus desirably possible. For gross adjustments the sleeve may be outward from the cylinder, the rod positioned to any extended position desired, and the sleeve retracted into abuttment. For fine adjustments, the sleeve may be advanced or retracted any desired small amount.

The preferred embodiment and the invention are now described in such full, clear, concise and exact terms as to enable a person of skill in the art to make and use the same. To particularly point out and distinctly claim the subject matter regarded as invention, the following claims conclude this specification.

What is claimed is:

1. A fluid cylinder device comprising:

a fluid cylinder including an adjusting sleeve bushing;

a piston rod;

a piston mounted to the piston rod and mounted in the fluid cylinder for movement of the piston and piston rod in an extending direction and a retracting direction;

means mounted on the cylinder for stopping the movement of the piston and piston rod in the extending direction at an extended position, the stopping means including a sleeve on the fluid cylinder, the piston rod being slidably mounted to the sleeve;

means operatively connected to the stopping means for adjusting the stopping means to adjust the extended position, the adjusting means including cooperating screw threads on the sleeve and fluid cylinder, the screw threads on the fluid cylinder being on the adjusting sleeve bushing;

a bushing retainer plate adjacent and retaining the adjusting sleeve bushing, the bushing retainer plate being affixed to the fluid cylinder; and a thread seal adjacent the adjusting sleeve bushing and bushing retainer plate, the thread seal surmounting the retainer plate.

2. A fluid cylinder device as in claim 1 in which the thread seal comprises a washer 21 with opposed rubber coatings 22, 23.

3. A fluid cylinder device as in claim 1 in which a seal encircles the sleeve bushing, sealing the bushing against the fluid cylinder.

4. A fluid cylinder device as in claim 1 further comprising at least one seal internal to the sleeve adjacent the piston rod, the seal sealing the rod against the sleeve.

* * * * *